US009611074B2

(12) United States Patent
Seifer et al.

(10) Patent No.: US 9,611,074 B2
(45) Date of Patent: Apr. 4, 2017

(54) CARTRIDGE FOR AT LEAST TWO FLOWABLE COMPONENTS

(71) Applicant: Sulzer Mixpac AG, Haag (CH)

(72) Inventors: Ralf Seifer, Sargans (CH); Manfred Obrist, Lustenau (AT)

(73) Assignee: SULZER MIXPAC AG, Haag (CH)

( * ) Notice: Subject to any disclaimer, the term of this patent is extended or adjusted under 35 U.S.C. 154(b) by 70 days.

(21) Appl. No.: 14/058,872

(22) Filed: Oct. 21, 2013

(65) Prior Publication Data

US 2014/0124508 A1 May 8, 2014

(30) Foreign Application Priority Data

Nov. 8, 2012 (EP) ..... 12191712

(51) Int. Cl.
*B67D 7/70* (2010.01)
*B65D 25/04* (2006.01)
*B05C 17/005* (2006.01)

(52) U.S. Cl.
CPC ..... *B65D 25/04* (2013.01); *B05C 17/00553* (2013.01)

(58) Field of Classification Search
CPC ..... A61M 5/1407; A61M 5/1408; A61M 5/2448; A61M 5/31596; A61M 5/3294;
(Continued)

(56) References Cited

U.S. PATENT DOCUMENTS 2,720,880 A * 10/1955 Whitaker et al. ..... 604/232
2,826,339 A * 3/1958 Maillard ..... A61M 3/00 222/137

(Continued)

FOREIGN PATENT DOCUMENTS

CN 1217278 A 5/1999
CN 102050275 A 5/2011

(Continued)

OTHER PUBLICATIONS

European search report for corresponding EP12191712.4-1760 issued on Apr. 11, 2013.

(Continued)

*Primary Examiner* — Paul R Durand
*Assistant Examiner* — Randall Gruby
(74) *Attorney, Agent, or Firm* — Global IP Counselors, LLP

(57) ABSTRACT

The invention relates to a cartridge for at least two flowable components.
The invention starts from a cartridge having at least two storage containers into which pistons can be inserted for dispensing components. So that the pistons cannot slip out of the storage containers again after the insertion, peripheral beads are provided at inner walls of the storage containers. To make possible cartridges which can be manufactured inexpensively and which can nevertheless be reliably sealed, it is proposed in accordance with the invention that the first inner wall has a first connection section and the second inner wall has a second connection section in which they do not have a bead. A connection web which connects the two storage containers is in this respect arranged between the first and second connection sections.

11 Claims, 2 Drawing Sheets

(58) Field of Classification Search
CPC ..... A61M 2005/31506; A61M 2005/31501; B29L 2031/715
USPC ..... 222/94, 135–137, 145.1, 145.3–145.6, 222/326, 386, 389–391, 327; 92/169.1, 92/146
See application file for complete search history.

(56) References Cited

U.S. PATENT DOCUMENTS 3,166,221 A * 1/1965 Nielsen ..... A61M 3/00 222/137
3,532,372 A * 10/1970 Stroud ..... 403/329
3,677,245 A * 7/1972 Welch ..... A61M 5/178 604/193
3,828,980 A * 8/1974 Creighton ..... B65D 81/325 222/137
3,889,351 A * 6/1975 Tischlinger ..... 29/447
3,952,920 A * 4/1976 Bergman ..... B27G 11/00 222/137
3,967,759 A * 7/1976 Baldwin et al. ..... 222/129
4,026,287 A * 5/1977 Haller ..... A61M 5/322 604/110
4,109,653 A * 8/1978 Kozam ..... A61C 5/02 604/191
4,121,739 A * 10/1978 Devaney ..... B05C 17/00553 222/137
4,139,311 A * 2/1979 Lorscheidt ..... A45D 40/02 215/341
4,260,077 A * 4/1981 Schroeder ..... B65D 81/325 206/366
4,269,330 A * 5/1981 Johnson ..... B65D 83/0005 222/386
4,381,778 A * 5/1983 Kozam ..... A61M 5/19 604/191
4,538,920 A * 9/1985 Drake ..... A61C 5/064 222/137
4,610,666 A * 9/1986 Pizzino ..... A61M 5/19 604/191
4,690,306 A * 9/1987 Staheli ..... B05C 17/00513 222/137
4,693,706 A * 9/1987 Ennis, III ..... A61M 5/31596 604/220
4,846,373 A * 7/1989 Penn ..... B05C 17/00516 222/137
4,869,403 A * 9/1989 Bruning ..... B65D 83/0005 222/327
4,872,396 A * 10/1989 Wimbush ..... B29C 70/70 264/274
4,932,941 A * 6/1990 Min et al. ..... 604/110
4,946,441 A * 8/1990 Laderoute ..... A61J 1/1406 604/110
4,966,468 A * 10/1990 Bruning ..... B65D 81/3255 222/190
4,981,241 A * 1/1991 Keller ..... A61C 5/064 222/137
4,986,813 A * 1/1991 Blake, III ..... A61M 5/322 604/110
5,027,981 A * 7/1991 Magister ..... B67D 3/0016 222/137
5,030,208 A * 7/1991 Novacek ..... A61L 2/28 604/110
5,033,650 A * 7/1991 Colin ..... A61C 5/062 222/137
5,106,372 A * 4/1992 Ranford ..... A61M 5/5013 604/110
5,112,315 A * 5/1992 Gloyer ..... A61M 5/3202 604/195
5,165,572 A * 11/1992 Bath ..... 222/83.5
5,171,300 A * 12/1992 Blake, III ..... A61M 5/322 604/110
5,188,601 A * 2/1993 King ..... A61M 5/322 604/110
5,205,826 A * 4/1993 Chen ..... A61M 5/322 604/110
5,205,827 A * 4/1993 Novacek ..... A61L 2/28 604/110
5,242,091 A * 9/1993 Ishida et al. ..... 222/386
5,249,709 A * 10/1993 Duckworth et al. ..... 222/137
5,263,933 A * 11/1993 Novacek ..... A61L 2/28 604/110
5,301,842 A * 4/1994 Ritter ..... 222/137
5,338,303 A * 8/1994 King ..... A61M 5/3243 604/110
5,401,246 A * 3/1995 Mazur ..... A61M 5/322 604/110
5,405,327 A * 4/1995 Chen ..... A61M 5/322 128/919
5,458,576 A * 10/1995 Haber ..... A61M 5/322 604/110
5,531,703 A 7/1996 Skwarek et al.
5,634,903 A * 6/1997 Kurose ..... A61M 5/315 604/110
5,647,510 A * 7/1997 Keller ..... B05C 17/00513 222/105
5,667,102 A * 9/1997 Keller ..... B05C 17/00513 222/327
5,725,499 A * 3/1998 Silverstein ..... A61M 5/19 222/145.1
5,858,000 A * 1/1999 Novacek et al. ..... 604/110
5,885,257 A * 3/1999 Badger ..... A61M 5/3232 604/110
5,931,813 A * 8/1999 Liu ..... A61M 5/322 604/110
5,964,735 A * 10/1999 Alexander ..... A61B 5/1405 604/110
5,968,019 A * 10/1999 Lee ..... A61M 5/322 604/110
5,968,020 A * 10/1999 Saito ..... A61M 5/322 604/110
6,006,948 A 12/1999 Auer
6,156,013 A * 12/2000 Mahurkar ..... A61M 5/322 604/195
6,173,869 B1 * 1/2001 Thayer ..... G01F 11/025 222/137
6,183,464 B1 * 2/2001 Sharp ..... A61M 5/322 604/195
6,342,045 B1 * 1/2002 Somers ..... 604/110
6,409,703 B1 * 6/2002 Lu ..... 604/110
6,409,972 B1 * 6/2002 Chan ..... 422/131
7,014,622 B1 * 3/2006 Pressly et al. ..... 604/110
8,430,276 B2 * 4/2013 Longo, II ..... 222/327
8,567,620 B2 * 10/2013 Ettlin et al. ..... 215/40
8,925,764 B2 * 1/2015 Hiemer ..... 222/137
2002/0087122 A1 * 7/2002 Sogaro ..... A61M 5/19 604/191
2003/0050597 A1 * 3/2003 Dodge ..... A61B 17/00491 604/82
2004/0054332 A1 * 3/2004 Ferguson ..... A61M 5/3129 604/220
2004/0068266 A1 * 4/2004 Delmotte ..... A61B 17/8816 606/92
2005/0049558 A1 * 3/2005 Knee et al. ..... 604/218
2005/0051576 A1 * 3/2005 Brugner ..... 222/145.1
2006/0178626 A1 * 8/2006 Axelsson et al. ..... 604/110
2007/0244443 A1 * 10/2007 Chen ..... 604/195
2009/0062741 A1 * 3/2009 Smith ..... A61M 5/19 604/191
2011/0095026 A1 * 4/2011 Habibi-Naini ..... 220/315
2011/0295212 A1 * 12/2011 Greter ..... A61B 17/00491 604/191
2013/0015205 A1 * 1/2013 Hiemer ..... 222/137
2013/0105515 A1 * 5/2013 Frey et al. ..... 222/137
2013/0123712 A1 * 5/2013 Ivosevic ..... 604/220
2014/0117046 A1 * 5/2014 Ettlin ..... 222/145.5

(56) References Cited

U.S. PATENT DOCUMENTS

FOREIGN PATENT DOCUMENTS

| | | | | |
|---|---|---|---|---|
| DE | 19711249 | A1 | | 9/1998 |
| DE | 202004017878 | U1 | | 2/2005 |
| EP | 0688727 | | * | 12/1995 |
| EP | 2314521 | A1 | | 4/2011 |

OTHER PUBLICATIONS

Chinese Search Report issued Nov. 9, 2016 in corresponding CN Patent Application No. 2013105460613, filed November 7, 2013 (with English Translation).

* cited by examiner

CARTRIDGE FOR AT LEAST TWO FLOWABLE COMPONENTS

PRIORITY CLAIM

The present application claims priority to European Patent Application No. 12191712.4 filed on Nov. 8, 2012, the disclosure of which is incorporated herein by reference.

BACKGROUND

The invention relates to a cartridge for at least two flowable components in accordance with the preamble of claim 1.

Cartridges for at least two flowable components having a filling end and a discharge end, with a component outlet being arranged at the discharge end, have already been marketed for some time by the applicant. These cartridges have a first storage chamber for a first component having a first inner wall extending between the filling end and the discharge end and having a first filling opening arranged at the filling end and also have a second storage chamber for a second component having a second inner wall extending between the filling end and the discharge end and having a second filling opening arranged at the filling end. The first and second storage chambers are connected to one another by means of a connection web. The first filling opening and the first inner wall are designed so that a first piston can be inserted into the first storage chamber such that it sealingly closes the first storage chamber. The second filling opening and the second inner wall are designed so that a second piston can be inserted into the second storage chamber such that it sealingly closes the second storage chamber. The first and second inner walls each have a bead running fully over the periphery in the region of the first and second filling openings by means of which bead the first and second pistons can be held captively, that is without risk of loss, after the insertion into the first and second chambers. The beads therefore prevent the piston from being able to slip out of the storage chambers after the insertion via the filling openings.

These cartridges are manufactured by means of an injection molding process, with a core required for the formation of the storage chambers and of the beads being pulled out through the filling openings after the opening of the injection tool without the use of pushers or of ejection pins or with the cartridge being removed from the core. A so-called forced demolding therefore takes place so that an inexpensive manufacture of the cartridges is possible. On the forced demolding of the cartridges in accordance with the prior art, permanent deformations of the beads can occur, with burrs being able to be formed which may result in damage to the pistons on the insertion of the pistons into the storage chambers. Pistons damaged in this manner can no longer reliably close the storage chambers so that, on the one hand, the components can be discharged past the pistons via the filling openings and, on the other hand, the components can come into contact with air, which can result in drying out or in unwanted chemical changes to the components.

SUMMARY

In light of this, it is the object of the invention to propose a cartridge for at least two flowable components which can be manufactured inexpensively and nevertheless allows a secure sealing of the storage chambers. In accordance with the invention, this object is satisfied by a dispensing apparatus having the features of claim 1.

In accordance with the invention, the first inner wall has a first connection section and the second inner wall has a second connection section in which they have no bead, with the connection web being arranged between the first and second sections. So the beads don't run fully over the periphery. Thus the named connection section of an inner wall without a bead is arranged at the same position as the bead relating to a dispensing direction. So the named connection sections are arranged in the region of the first and second filling openings.

The invention is based on the recognition that it is necessary in the above-described forced demolding that the cartridge or the storage chambers in particular have to be slightly elastically widened in the region of the beads on the pulling out of the core. This is also possible without problem per se since the cartridge has a sufficient elasticity after the injection molding. This widening may, however, not take place sufficiently under certain circumstances in the region of the connection webs, via which region the storage chambers are connected, since the storage chambers would have to widen in opposite directions, which is, however, only possible with great restrictions due to an only very small thickness of the connection web. With beads running fully around the periphery, burrs which may damage the pistons on insertion can therefore in particular form in the region of the connection web on the forced demolding. The creation of these burrs can be effectively prevented, on the one hand, by the provision in accordance with the invention of the described connection sections without a bead and the partly peripheral beads can nevertheless still satisfy their function of securing the piston. Due to the design in accordance with the invention of the cartridge, the latter can furthermore be manufactured by means of an injection molding process with forced demolding so that an inexpensive manufacture of the cartridge is made possible.

A bead should be understood as an elevated portion of the inner walls of the storage chambers to the inside which extends contiguously in the peripheral direction of the inner wall. The bead in particular extends in parallel to the filling opening and thus perpendicular to a dispensing direction which is oriented between the filling end and the discharge end and parallel to which the pistons are displaced on the dispensing of the components. The beads in particular have a width oriented in the dispensing direction between 0.2 and 0.5 mm and an inwardly oriented height between 0.2 and 0.5 mm. The beads in particular only have rounded or so-called soft transitions and thus do not have sharp corners or edges. The forced demolding is thus facilitated, on the one hand, and the insertion of the pistons, on the other hand.

The features that the pistons can be held captively in the storage chambers should be understood such that the pistons can only be pushed out of the storage chamber again after the insertion and thus after overcoming a resistance. The amount of the resistance is in particular dependent on the property of the bead, but also on the property of the piston. If the piston is very steep at its periphery, the resistance is higher than with a soft piston. The cartridge and the associated pistons are in particular designed so that there is sufficient resistance that the piston is not pushed over the bead at a pressure of approximately 1 to 2 bar within the storage chamber.

The storage chambers in particular have a round cross-section and thus a mainly hollow cylindrical basic shape. It is, however, also possible, for example, that they have a square or rectangular cross-section. The cartridge can also have more than two storage chambers, that is, for example, three or four storage chambers. Each storage chamber in particular has a separate component outlet so that the cartridge has at least two component outlets. A mixer, in particular a static mixer, can be plugged onto the cartridge, for example, said mixer mixing the components after the dispensing from the component outlets.

The cartridges can in particular be composed of polyamide or polybutylene terephthalate but also of polypropylene or polyethylene, for example. The cartridges can, for example, be configured for a filling quantity of the components up to approximately 400 ml, in particular up to 200 ml, with the two storage chambers being able to be of equal size or of different sizes. The storage chambers then have a wall thickness, for example, of approximately 1.0 to 2.5 mm. The design of the beads in accordance with the invention is in particular advantageous with small cartridges having a filling quantity up to approximately 200 ml and made from less flexible material such as polyamide since burrs can in particular arise on the forced demolding in this constellation.

In an embodiment of the invention, the first and/or second connection section is composed of 10-40%, preferably 20-30%, particularly preferably 25% of a periphery of the first or second inner wall. The first and second connection sections can in this respect be of equal size or also different. The percentage amount of the connection sections in the total periphery is in particular larger with storage chambers having small diameters than with storage chambers having larger diameters. The named selection of the size of the connection section offers a good compromise between the manufacturing capability of the cartridge without burrs and the resistance which can be applied by the beads.

In an embodiment of the invention, the first and second inner walls have a round cross-section with a first and second center point. The storage chambers thus have a mainly hollow cylindrical basic shape. The first and second connection stages are seen in a top view in dispensing direction arranged symmetrical to a connection line between the first and second center points. It can thus be achieved that the connection sections can be kept as small as possible and the named resistance is thus as large as possible.

The cartridge in accordance with the invention can be used, for example, for medical applications, in particular in the dental sector. Applications are, however, also possible in many other sectors in which two or more components only have to be mixed directly prior to use.

Further advantages, features and details of the invention result with reference to the following description of embodiments and with reference to drawings in which elements which are the same or have the same function are provided with identical reference numerals.

Additional features and advantages are described herein, and will be apparent from the following Detailed Description and the figures.

DETAILED DESCRIPTION

Figure 1:
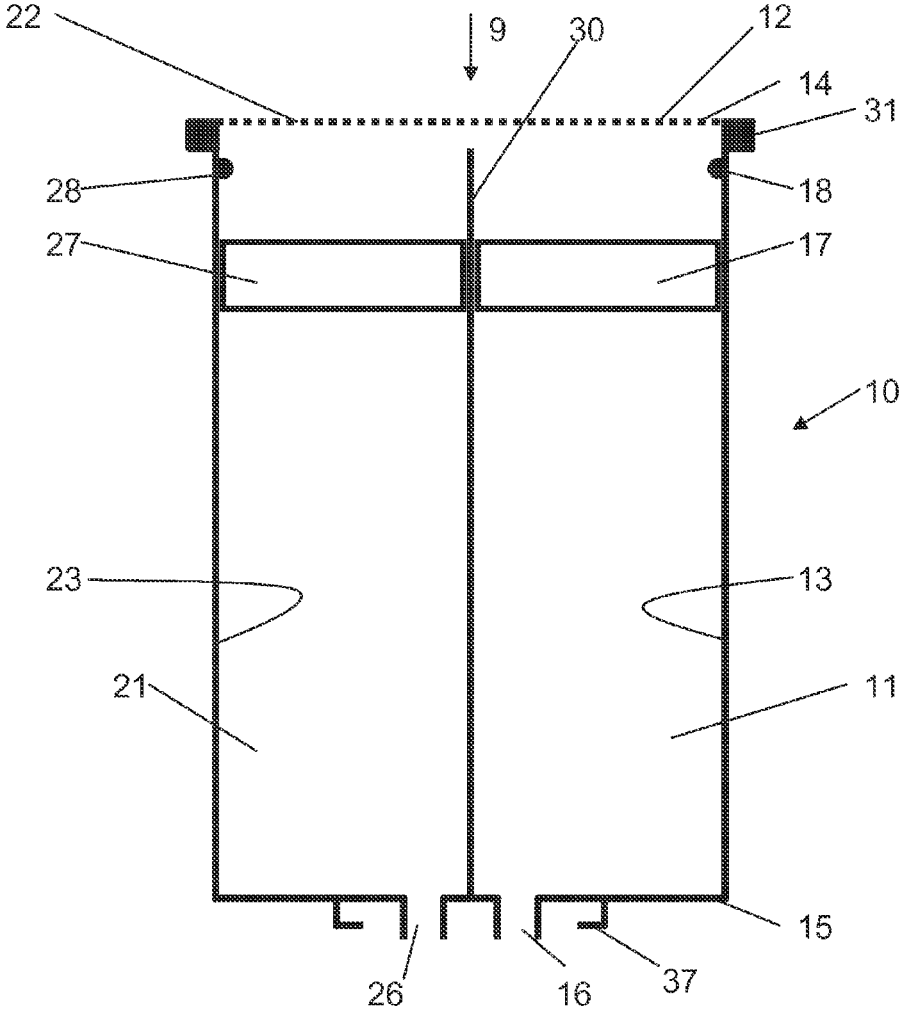
FIG. 1 a schematic representation of a cartridge in a cross-section.

In accordance with FIG. 1, a cartridge 10 has a first storage chamber 11 with a predominately hollow cylindrical basic shape. At a filling end 14 of the cartridge 10, the first storage chamber 11 has a first filling opening 12 via which a first component can be filled into the first storage chamber 11. A first inner wall 13 of the first storage chamber 11 expends from the filling end 14 of the cartridge 10 up to a discharge end 15 of the cartridge 10. At the discharge end 15, the first storage chamber 11 has a first component outlet 16 via which the first component can be dispensed from the first storage chamber 11.

A first, predominately cylindrical piston 17 can be inserted into the first storage chamber 11 via the first filling opening 12. The first piston 17 is designed so that it tightly closes the first storage chamber 11 in the direction of the first filling opening 12 after the insertion. The first piston 17 is shown very schematically. It can in particular have soft sealing lips running around at the periphery. The first component can be pushed out of the first storage chamber 11 by displacing the first piston 17 in the direction of the first component outlet 16 and thus in the direction of a dispensing direction 9. The first piston 17 can be displaced in the direction of the first component outlet 16 by means of a dispensing device, not shown.

Parallel to the first storage chamber 11, an identically designed second storage chamber 21 is arranged which has a second filling opening 22, a second inner wall 23 and a second component outlet 26. A second piston 27, can be inserted analog to the first piston 17 into the second storage chamber 21. The two storage chambers 11 and 21 are connected to one another by means of a connection web 30.

Figure 2:
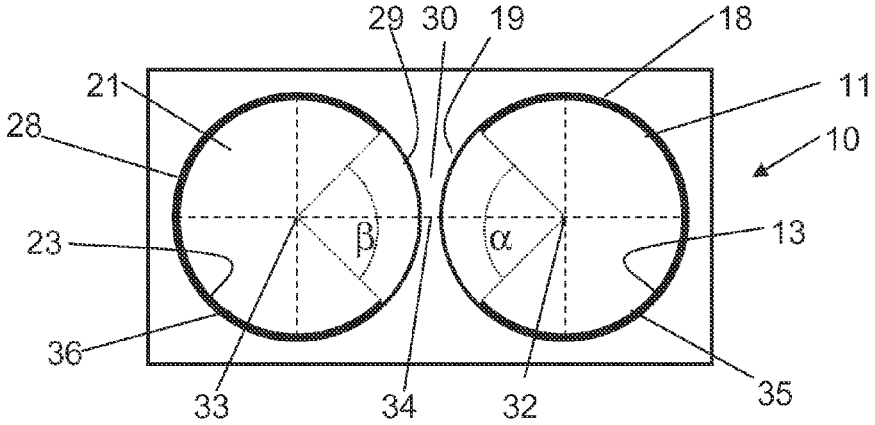
FIG. 2 the cartridge of FIG. 1 in a plan view of its filling end.

In the region of the first and second filling openings 12, 22 respectively, the inner walls 13, 23 each have a bead 18, 28 partly running around. The beads 18, 28 serve to ensure that the pistons 17, 27 do not slip out again via the filling openings 12, 22 after the insertion into the storage chambers 11, 21. Since the beads 18, 28, as can be seen in FIG. 2, do not fully run around, they can each be seen only at the side of the inner walls 13, 23 disposed opposite the connection web 30. The beads 18, 28 are likewise only shown very schematically and additionally in a somewhat exaggerated matter. The beads 18, 28 have a width oriented in the dispensing direction 9 between 0.2 and 0.5 mm and have a height oriented inwardly, that is in the direction of the connection web 30, between 0.2 and 0.5 mm.

The cartridge 10 has a connector flange 31 at the filling end 14 for the secure connection to the dispensing device, not shown. A part 37 of a bayonet fastening, via which a static mixer, not shown, can be connected to the cartridge 10, is arranged at the discharge end 15 around the component outlets 16 and 26. The components dispensed from the component outlets 16 and 26 are thus supplied to the mixer and are mixed by it.

As can be seen in FIG. 2, in which a plan view of the filling end 14 of the cartridge 10 is shown, the beads 18, 28 of the first and second storage chambers 11, 21 are not designed as fully running around.

The first inner wall 13 has a first connection section 19 which does not have a bead. Analog to this, the second inner wall 23 has a second connection section 29 which likewise has no bead. The connection web 30 is arranged between the two connection sections 19, 29.

The first connection section 19 extends over an angular range $\alpha$ of 90°, that is over 25% of the total periphery of the first inner wall 13. The first connection section 19 is in this respect arranged symmetrically to a connection line 34 which connects a first center point 32 of the first inner wall 13 and a second center point 33 of the second inner wall 23 to one another.

The second connection section 29 is designed analog to the first connection section 19. It extends over an angular range β of likewise 90°, that is over 25% of the total periphery of the second inner wall 23. The second connection section 29 is in this respect likewise arranged symmetrical to the connection line 34.

The beads 18 and 28 are likewise shown very schematically in FIG. 2. The beads 18 and 28 also in particular have no sharp corners and edges at their ends oriented toward the connection sections 19 and 29.

The periphery of the first inner wall 13 is composed of the first connection section 19 and a first bead section 35 which has the first bead 18. Analog to this, the periphery of the second inner wall 23 is composed of the second connection section 29 and of a second bead section 36 which has the second bead 28.

In the embodiments shown of the cartridge in accordance with the invention, the beads have no interruptions except for the connection regions. It is, however, by all means possible that further small interruptions are provided.

The cartridge 10 is manufactured by means of an injection molding process. So-called cores are required for forming the storage chambers 11, 21 and also the beads 18, 28. After the actual injection molding, in which the cartridge 10 is created, an injection tool required for forming the outer contour is opened and the cores are subsequently removed. On the manufacture of the cartridges 10 in accordance with the invention, no pushers or ejection pins are used in the removal of the cores, but the cores are rather removed from the storage containers by means of a so-called forced demolding.

Figure 3:
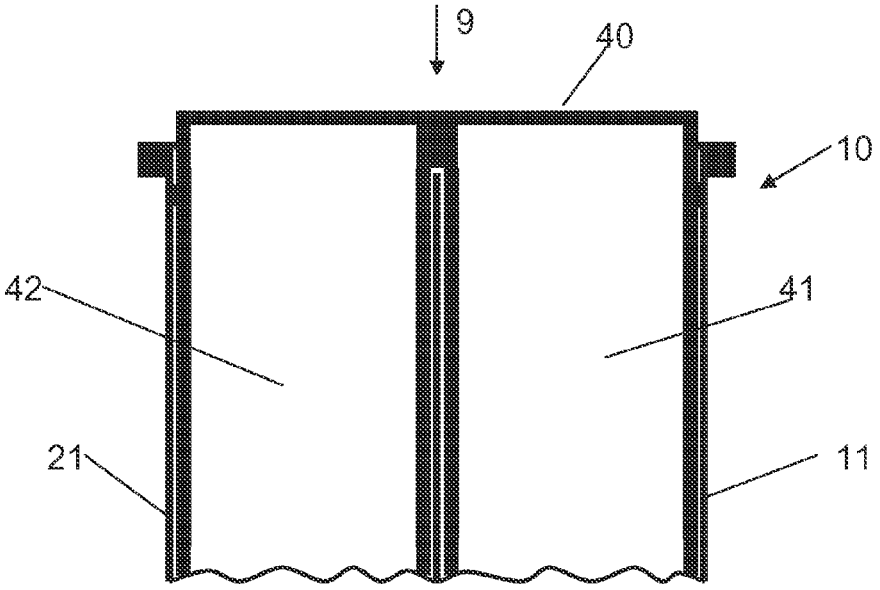
FIG. 3 a detail of a cartridge with a completely received core.
Figure 4:
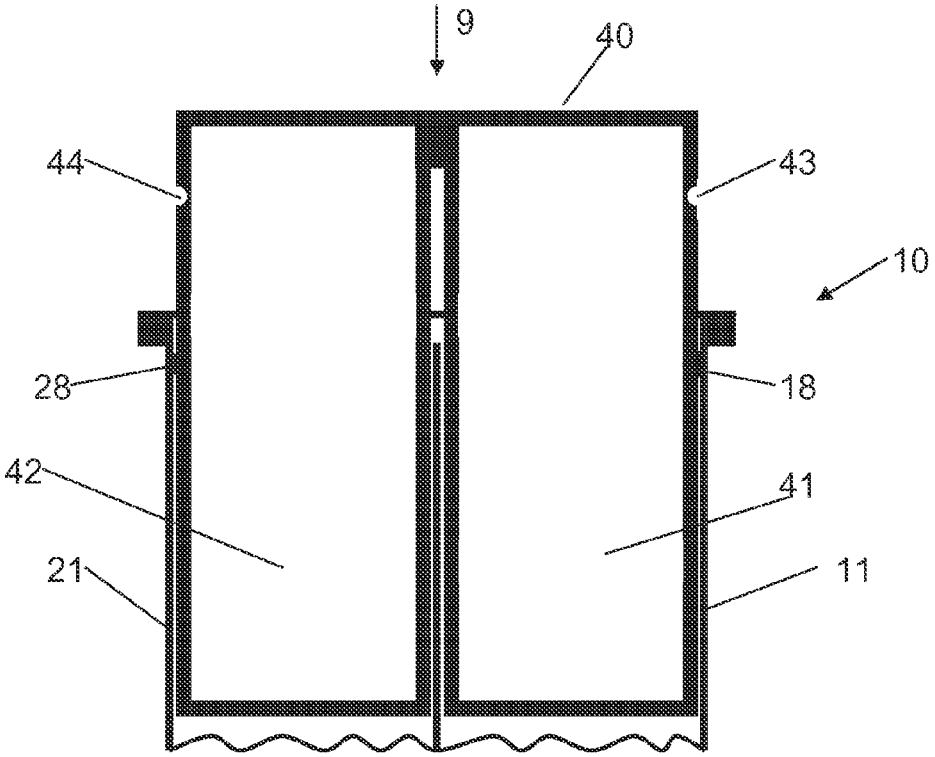
FIG. 4 the cartridge of FIG. 3 with a partly pulled-out core.

In FIG. 3, a detail of a cartridge 10 is shown with a two-part core 40 prior to the start of the forced demolding. FIG. 4 shows the same arrangement with a partly removed core 40, with the core 40 being removed against the dispensing direction 9.

The core 40 has a first part core 41 for forming the first storage chamber 11 and a second part core 42 for forming the second storage chamber 21. The first part core 41 has a first groove 43, which can only be seen in FIG. 4, for forming the first bead 18 of the first storage chamber 11. Analog to this, the second part core 42 has a second groove 44, which can only be seen in FIG. 4, for forming the second bead 28 of the second storage chamber 21.

On the removal of the core 40, the storage chambers 11, 21 slightly widen, which is, however, not shown in FIG. 4.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A cartridge configured to receive at least two flowable components comprising:

a first storage chamber configured to receive a first component, the first storage chamber having a first inner wall extending between a filling end of the cartridge and a discharge end of the cartridge, the first storage chamber further having a first filling opening arranged at the filling end, the first storage chamber being further configured to receive a first piston through the first filling opening to sealingly close the first storage chamber;

a second storage chamber connected to the first storage chamber by a connection web, the second storage chamber being configured to receive a second component and having a second inner wall extending between the filling end and the discharge end, the second storage chamber having a second filling opening arranged at the filling end and being further configured to receive a second piston through the second filling opening to sealingly close the second storage chamber; and a component outlet arranged at the discharge end, the first and second inner walls each having a peripheral bead disposed in a region of the first and second storage chambers having the first and second filling openings, the peripheral bead of the first inner wall extending in a circumferential direction on the first inner wall and the peripheral bead of the second inner wall extending in a circumferential direction on the first and second inner walls so that the peripheral beads of the first and second inner walls are configured to hold the first and second pistons inside the first and second storage chambers respectively, the first inner wall having an unbeaded first connection section and the second inner wall having an unbeaded second connection section, the connection web being arranged between the first and second connection sections, each of the first and second connection sections extend over an angle that is 90 degrees, and the peripheral bead of the first inner wall extends over an angle that is 270 degrees and the peripheral bead of the second inner wall extends over an angle that is 270 degrees.

2. The cartridge in accordance with claim 1, wherein the first and second inner walls have a round cross-section with a first and a second center point, respectively, the first and second connection sections being arranged symmetrical to a connection line between the first and second center points.

3. The cartridge in accordance with claim 1, wherein the beads have a height between 0.2 and 0.5 mm.

4. The cartridge in accordance with claim 3, wherein the beads have a width between 0.2 and 0.5 mm.

5. A cartridge configured to receive at least two flowable components, comprising:

a first storage chamber configured to receive a first component, the first storage chamber having a first inner wall extending between a filling end of the cartridge and a discharge end of the cartridge, the first storage chamber further having a first filling opening arranged at the filling end, the first storage chamber being further configured to receive a first piston through the first filling opening to sealingly close the first storage chamber;

a second storage chamber connected to the first storage chamber by a connection web, the second storage chamber being configured to receive a second component and having a second inner wall extending between the filling end and the discharge end, the second storage chamber having a second filling opening arranged at the filling end and being further configured to receive a second piston through the second filling opening to sealingly close the second storage chamber; and a component outlet arranged at the discharge end, the first and second inner walls each having a peripheral bead disposed in a region of the first and second storage chambers having the first and second filling openings, the peripheral bead of the first inner wall extending in a circumferential direction on the first inner wall and the peripheral bead of the second inner wall extending in a circumferential direction on the first and second inner walls so that the peripheral beads of the first and second inner walls are configured to hold the first and second pistons inside the first and second storage chambers respectively, the first inner wall having an unbeaded first connection section and the second inner wall having an unbeaded second connection section, the connection web being arranged between the first and second connection sections, and the peripheral beads of the first and second inner walls extending along a majority of the first and second inner walls.

6. The cartridge in accordance with claim 5, wherein the first or second connection sections include 10-40% of a periphery of the first or second inner walls.

7. The cartridge in accordance with claim 5, wherein the first or second connection sections include 20-30% of a periphery of the first or second inner walls.

8. The cartridge in accordance with claim 5, wherein the first or second connection sections include 25% of a periphery of the first or second inner walls.

9. The cartridge in accordance with claim 5, wherein the first and second inner walls have a round cross-section with a first and a second center point, respectively, the first and second connection sections being arranged symmetrical to a connection line between the first and second center points.

10. The cartridge in accordance with claim 5, wherein the beads have a height between 0.2 and 0.5 mm.

11. The cartridge in accordance with claim 5, wherein the beads have a width between 0.2 and 0.5 mm.

* * * * *